US012692031B2

(12) United States Patent
Bhaskara et al.

(10) Patent No.: US 12,692,031 B2
(45) Date of Patent: Jul. 28, 2026

(54) AUTONOMOUS PACKAGING MACHINE AND A METHOD THEREOF

(71) Applicant: Tata Consultancy Services Limited, Mumbai (IN)

(72) Inventors: Mohan Bhaskara, Bangalore (IN); Mahesha Gunmi, Bangalore (IN); Ullas Chennabettu Keshava, Bangalore (IN); Sridhar Jayaraman, Chennai (IN); Babu Unnikrishnan, Chennai (IN); Mahesh Mittalakatte Chikkappa, Bangalore (IN)

(73) Assignee: TATA CONSULTANCY SERVICES LIMITED, Mumbai (IN)

( * ) Notice: Subject to any disclaimer, the term of this patent is extended or adjusted under 35 U.S.C. 154(b) by 0 days.

(21) Appl. No.: 18/980,045

(22) Filed: Dec. 13, 2024

(65) Prior Publication Data

US 2025/0197042 A1 Jun. 19, 2025

(30) Foreign Application Priority Data

Dec. 15, 2023 (IN) ..... 202321085801

(51) Int. Cl.
*B65B 9/04* (2006.01)
*B65B 35/24* (2006.01)
(Continued)

(52) U.S. Cl.
CPC ..... *B65B 9/04* (2013.01); *B65B 35/24* (2013.01); *B65B 35/56* (2013.01); *B65B 41/16* (2013.01);
(Continued)

(58) Field of Classification Search
USPC ..... 53/415
See application file for complete search history.

(56) References Cited

U.S. PATENT DOCUMENTS

2003/0019189 A1 1/2003 Weaver et al.
2022/0258901 A1* 8/2022 Phillips ..... B65B 57/12
(Continued)

FOREIGN PATENT DOCUMENTS

WO WO 2005/085071 A2 9/2005

*Primary Examiner* — Chinyere J Rushing-Tucker
(74) *Attorney, Agent, or Firm* — Finnegan, Henderson, Farabow, Garrett & Dunner, LLP

(57) ABSTRACT

End of line packaging automation is an automated technology that is operated at end of production line to pack products. Existing packaging machines occupy greater footprints, with huge material wastage and loss of material. Embodiments herein provide an autonomous packaging machine for packaging objects. Autonomous packaging machine includes centering unit with two centering actuators moving in opposing directions to align objects symmetrically about central line of a tensioned package material. Web guide roller moves in predefined arc carrying a tail of package material roll to align between the web guide roller and nip roller. Forming rods create a hollow brick type cavity for the package. Centre sealing with hot sealing jaws and fluted jaws to press package material and seal at centre with object placed inside. Outfeeder carries centre sealed packed objects from infeeder to exit conveyor. Set of four hot sealers for sealing on both sides of formed pack.

19 Claims, 16 Drawing Sheets

(51) Int. Cl.

| | |
|---|---|
| ***B65B 35/56*** | (2006.01) |
| ***B65B 41/16*** | (2006.01) |
| ***B65B 51/30*** | (2006.01) |
| ***B65B 57/12*** | (2006.01) |
| ***B65B 59/00*** | (2006.01) |
| ***B65B 61/08*** | (2006.01) |

(52) U.S. Cl.
CPC ..... *B65B 51/30* (2013.01); *B65B 57/12* (2013.01); *B65B 59/001* (2019.05); *B65B 61/08* (2013.01)

(56) References Cited

U.S. PATENT DOCUMENTS

| | | | | |
|---|---|---|---|---|
| 2023/0278736 | A1* | 9/2023 | Chang | B65B 35/58 53/449 |
| 2025/0033817 | A1* | 1/2025 | Talda | B65B 41/16 |
| 2025/0033820 | A1* | 1/2025 | Talda | B65B 61/025 |
| 2025/0033821 | A1* | 1/2025 | Talda | B65B 41/14 |
| 2025/0033850 | A1* | 1/2025 | Talda | B65B 57/08 |

* cited by examiner

AUTONOMOUS PACKAGING MACHINE AND A METHOD THEREOF

PRIORITY CLAIM

This U.S. patent application claims priority under 35 U.S.C. § 119 to: Indian Patent Application number 202321085801, filed on Dec. 15, 2023. The entire contents of the aforementioned application are incorporated herein by reference.

TECHNICAL FIELD

The disclosure herein generally relates to a packaging system, and, more particularly, to an autonomous packaging machine and a method thereof.

BACKGROUND

End of line packaging automation is an automated technology that is operated at end of a production line that ensures product is packed/wrapped, checked, and prepared such that it is ready to be delivered to distributors, channels, wholesalers, retailers or market outlets at right time and right quality. Existing packaging machines occupy greater footprint. The existing packaging machines create boxes by cutting an optimal sized case blank from a continuous sheet of board. The corrugated board is built to the object size by robotic manipulation and finally the corrugated box is taped. Existing solutions also make a custom fit package with polypack material. The objects are moved against a film and the two sides are heat sealed to form a sealed pack. the excess portion of the pack in two directions is cut off after sealing process. The cut material is not reused hence there is huge material wastage. Existing solutions either pack the objects with preformed packs or seal at a fixed width or height. This results in loss of material when the objects to be packed are smaller in dimension.

SUMMARY

Embodiments of the present disclosure present technological improvements as solutions to one or more of the above-mentioned technical problems recognized by the inventors in conventional systems. For example, in one aspect, there is provided an autonomous packaging machine for packaging of one or more objects. The autonomous packaging machine includes: an entry barrier associated with a marker, allows one or more objects to be conveyed on an infeed conveyor based on one or more parameters associated with one or more objects; one or more package material roll lines to which the one or more objects are conveyed through the infeed conveyor; an infeeder is a dancing belt design to move in outward and inward direction; a centering unit include two centering actuators being moved in opposing directions to align the one or more objects symmetrically about a central line of a tensioned package material; a mandrel is pneumatically expandable to hold a core of the packaging material; a web guide roller moves in a pre-defined arc carrying a tail of a package material roll to align between the web guide roller and a nip roller; the package material gripping unit include one or more vacuum grippers to firmly grip the material against a movement of the one or more forming rods; a centre sealing and package unit include one or more hot sealing jaws with one or more fluted jaws to press the package material and to seal at centre with the one or more objects placed inside; a pack forming unit include set of actuators and the one or more forming rods; an out feeder carries the one or more centre sealed packed objects from the infeeder to an exit conveyor; the one or more pair of side sealers includes a set of four hot sealers for sealing on both side of a formed pack. The associated marker of the entry barrier assists to position the one or more objects centrally on the infeed conveyor. The one or more package material roll lines corresponds to: (i) a first package material roll line, and (ii) a second package material roll line. The movement of the infeeder in the outward direction creates a recess for a package material gripping unit to move up and down. The movement of the infeeder in the inward direction closes the recess to carry forward the one or more objects in the one or more package material roll lines conveyed through the infeed conveyor. The one or more objects is stopped by an object placement indication sensor at the end of the infeeder. A tensioned packaging material cavity is created by one or more forming rods based on a measured dimension, and the one or more objects are pushed into the tensioned packaging material cavity by an object pusher unit (OPU). The object pusher unit (OPU) includes a first actuator, and a second actuator. The mandrel can be rotated in a clockwise (CW) direction, or a counterclockwise (CCW) direction respectively. The nip roller provides additional friction for a material to be packaged. A web guide unit guides the aligned tail of the package material roll in a slot for the package material to be fed without wrinkles. A vacuum generator generates enough vacuum for every gripping stroke. The sealing depends on the temperature, pressure applied by the two hot sealing jaws on the material, and dwell time. The one or more forming rods together with the one or more hot sealing jaws with one or more fluted jaws create a hollow brick type cavity for the package. The exit conveyor is a last conveyor which takes the one or more centre sealed packed objects to centre of one or more pair of side sealers mounted on corresponding frame to seal each side the one or more objects. Each pair with top and bottom sealers are placed on edge of the package in a fixed location.

In an embodiment, one or more objects are scanned by an object scanning unit to determine the one or more parameters. In an embodiment, the one or more parameters correspond to: (i) width, and (ii) height. In an embodiment, the one or more parameters are required to calculate quantity of packaging material required for a pack, for actuation of the one or more forming rods, and actuation of the OPU. In an embodiment, a material roll with a higher roll width for longer objects are allowed to be conveyed in the first package material roll line. In an embodiment, a material roll with a smaller roll width for other objects is diverted by a diverter on a cross feed conveyor. In an embodiment, the diverter actuates the one or more objects autonomously based on associated length, and wherein the diverter is actuated by a pneumatic actuator. In an embodiment, the first actuator corresponds to an object pusher vertical unit (OPVU), and the second actuator corresponds to an object pusher horizontal unit (OPHU) respectively. In an embodiment, the first actuator is in an upward position which is a default configuration allowing the one or more objects to pass through to the infeeder. In an embodiment, the first actuator is moved vertically down till the level of the infeeder, and the one or more objects are pushed by the second actuator based on a measured dimension associated with the one or more objects scanned through the object scanning unit. In an embodiment, a stroke length upward and downward is always fixed for the first actuator.

In an embodiment, top and bottom forming rods split into two parts to move vertically based on height of the one or more objects and then moved horizontally based on width of the one or more objects. In an embodiment, the one or more forming rods are withdrawn and move back to the default position once the centre sealing is performed. In an embodiment, the default position corresponds to the front end of the out feeder. In an embodiment, the top and bottom sealers move towards each other during sealing by an equidistant for sealing and move back to the default location after sealing. In an embodiment, a bill printer is located below the mandrel on the machine structure frame which allows to position an associated printed bill over each object. In an embodiment, a label printer is located behind the web guide unit which allows to stick an associated printed label over each package. In an embodiment, the associated printed label corresponds to an identifier associated with each package. In an embodiment, the quality of the associated printed label is validated by a vision-based quality control unit. In an embodiment, a package quality control unit which allows one or more qualified packages to pass through the exit conveyor.

In another aspect, there is provided a processor-implemented method for packaging of one or more objects using an autonomous packaging machine comprising: an entry barrier associated with a marker, allows one or more objects to be conveyed on an infeed conveyor based on one or more parameters associated with one or more objects; one or more package material roll lines to which the one or more objects are conveyed through the infeed conveyor, an infeeder is a dancing belt design to move in outward and inward direction; a centering unit includes two centering actuators being moved in opposing directions to align the one or more objects symmetrically about a central line of a tensioned package material. The associated marker of the entry barrier assists to position the one or more objects centrally on the infeed conveyor. The one or more package material roll lines corresponds to: (i) a first package material roll line, and (ii) a second package material roll line. The movement of the infeeder in the outward direction creates a recess for a package material gripping unit to move up and down. The movement of the infeeder in the inward direction closes the recess to carry forward the one or more objects in the one or more package material roll lines conveyed through the infeed conveyor. The one or more objects is stopped by an object placement indication sensor at the end of the infeeder. A tensioned packaging material cavity is created by one or more forming rods based on a measured dimension, and the one or more objects are pushed into the tensioned packaging material cavity by an object pusher unit (OPU). The object pusher unit (OPU) includes a first actuator, and a second actuator.

Further, the processor-implemented method comprises adjusting, a pack forming unit based on height of the one or more objects; moving, a web guide roller, in a pre-defined arc carrying a tail of a package material roll to align between the web guide roller and a nip roller; gripping, by the package material gripping unit, the tensioned package material; pressing, by one or more hot sealing jaws with one or more fluted jaws, the package material to seal at centre with the one or more objects placed inside; carrying, by an out feeder, the one or more centre sealed packed objects from the infeeder to an exit conveyor; and sealing, by the one or more pair of side sealers, the one or more centre sealed packed objects at each side, and pushed through the exit conveyor. The infeeder is relocated to a default position. The pack forming unit includes a set of actuators and the one or more forming rods. The one or more forming rods together with the one or more hot sealing jaws with one or more fluted jaws create a hollow brick type cavity for the package. The nip roller provides additional friction for a material to be packaged. A web guide unit guides the aligned tail of the package material roll in a slot for the package material without wrinkles. The mandrel is pneumatically expandable to hold a core of the packaging material. The mandrel can be rotated in a clockwise (CW) direction, or a counterclockwise (CCW) direction respectively. The package material gripping unit includes one or more vacuum grippers to firmly grip the material against a movement of the one or more forming rods. Enough vacuum for every gripping stroke is generated by a vacuum generator. The sealing depends on temperature, pressure applied by the two hot sealing jaws on the material, and dwell time. The exit conveyor is a last conveyor which takes the one or more centre sealed packed objects to centre of one or more pair of side sealers mounted on corresponding frame to seal the one or more objects. The one or more pair of side sealers includes a set of four hot sealers for sealing on both sides of a formed pack. Each pair with top and bottom sealers are placed on edge of the package in a fixed location.

In an embodiment, one or more objects are scanned by an object scanning unit to determine the one or more parameters. In an embodiment, the one or more parameters correspond to: (i) width, and (ii) height. In an embodiment, the one or more parameters are required to calculate quantity of packaging material required for a pack, for actuation of the one or more forming rods, and actuation of the OPU. In an embodiment, a material roll with a higher roll width for longer objects is allowed to be conveyed in the first package material roll line. In an embodiment, a material roll with a smaller roll width for other objects are diverted by a diverter on a cross feed conveyor. In an embodiment, the diverter actuates one or more objects autonomously based on associated length, and wherein the diverter is actuated by a pneumatic actuator. In an embodiment, the first actuator corresponds to an object pusher vertical unit (OPVU), and the second actuator corresponds to an object pusher horizontal unit (OPHU) respectively. In an embodiment, the first actuator is in an upward position which is a default configuration allowing the one or more objects to pass through to the infeeder. In an embodiment, the first actuator is moved vertically down till the level of the infeeder, and the one or more objects are pushed by the second actuator based on a measured dimension associated with the one or more objects scanned through the object scanning unit. In an embodiment, a stroke length upward and downward is always fixed for the first actuator.

In an embodiment, top and bottom forming rods split into two parts to move vertically based on height of the one or more objects and then moved horizontally based on width of the one or more objects. In an embodiment, the one or more forming rods are withdrawn and move back to the default position once the centre sealing is performed. In an embodiment, the default position corresponds to the front end of the out feeder. In an embodiment, the top and bottom sealers move towards each other during sealing by an equidistant for sealing and move back to the default location after sealing. In an embodiment, a bill printer is located below the mandrel on the machine structure frame which allows to position an associated printed bill over each object. In an embodiment, a label printer is located behind the web guide unit which allows to stick an associated printed label over each package. In an embodiment, the associated printed label corresponds to an identifier associated with each package. In an embodiment, the quality of the associated printed label is validated by a vision-based quality control unit. In an embodiment, a package quality control unit which allows one or more qualified packages to pass through the exit conveyor.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this disclosure, illustrate exemplary embodiments and, together with the description, serve to explain the disclosed principles.

DETAILED DESCRIPTION

Figure 1A:
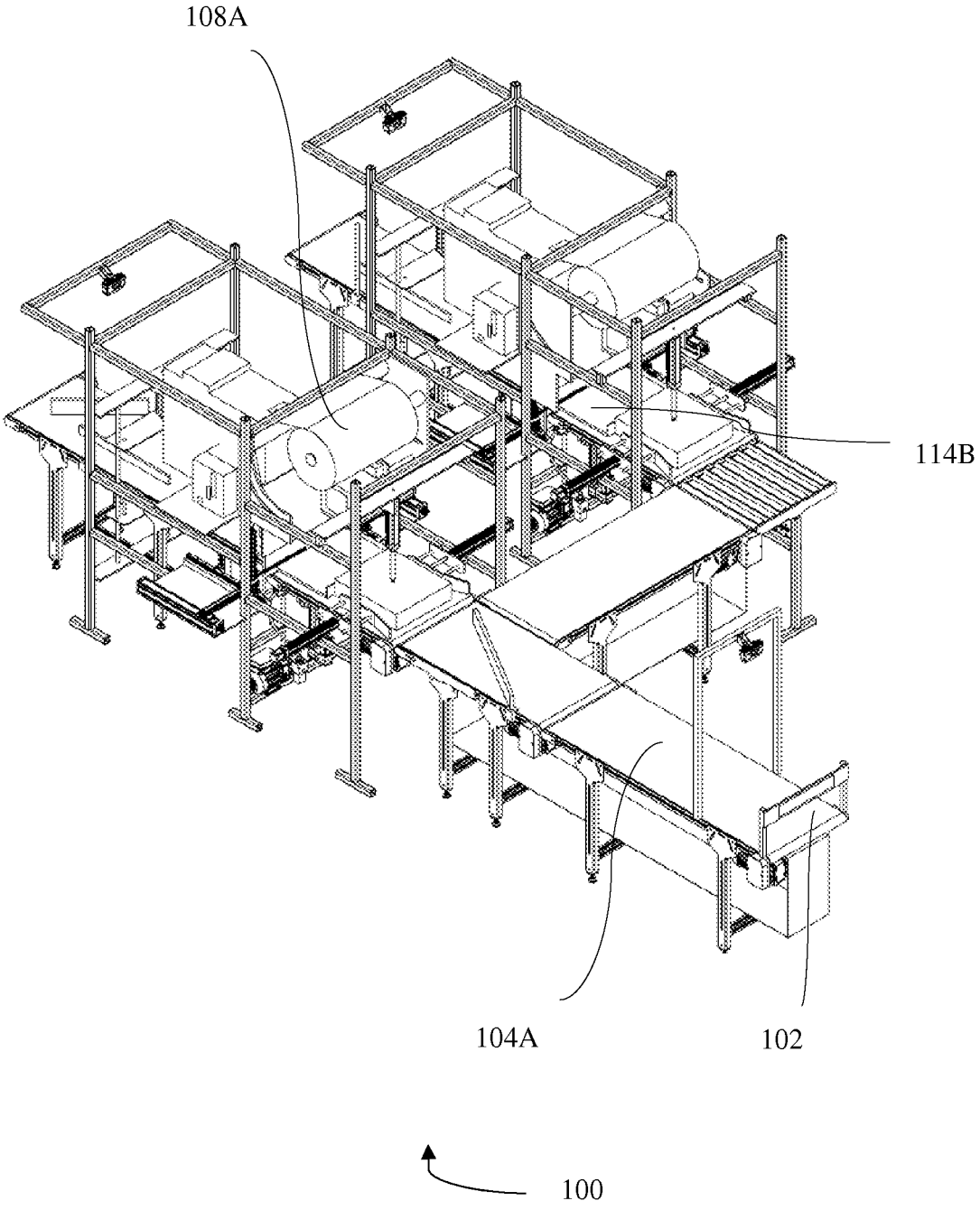
FIG. 1A and FIG. 1B are isometric view and front view respectively illustrating a closed configuration associated with an infeeder of an autonomous packaging machine for packaging one or more objects, according to some embodiments of the present disclosure.

Exemplary embodiments are described with reference to the accompanying drawings. In the figures, the left-most digit(s) of a reference number identifies the figure in which the reference number first appears. Wherever convenient, the same reference numbers are used throughout the drawings to refer to the same or like parts. While examples and features of disclosed principles are described herein, modifications, adaptations, and other implementations are possible without departing from the scope of the disclosed embodiments.

There is a need for an efficient tool to pack objects of any dimension. Embodiments of the present disclosure provide an autonomous packaging machine to pack objects with a form-fill and a three-side sealing technique with a custom cut feature using sustainable packaging material. The object to be packaged is passed through an entry barrier, which denies entry to object beyond the defined height and width. The customization of packing material with respect to the width and height of the object. The object arriving on the infeeder moves out i.e., default position and pack forming rods adjusts per the height and the width of the object. A dancing belt mechanism of a dancing belt conveyor allows smaller width objects to be packaged and thereby maintaining a high throughput. The data is transferred to a programmable logic controller (PLC) for autonomous determination of line diversion and pack formation. An object pusher system allows the object to enter an infeeder. An object placement sensor stops the object at the end of the infeeder which is in a default configuration. The default configuration in which a gap between the infeeder and an out feeder is allowed, and through this recess a material gripping system to grip and pull down the package material holding under tension. A pack forming system consisting of forming rods adjusts per height and width of the object to be packed. The infeeder is moved in, such that there is no gap left between the infeeder and the out feeder other than the thickness of the package material. A pusher system with two actuations, i.e., a first actuation moves vertically down to the level of the infeeder, and a second actuation equaling the width of the object that pushes the object against into the cavity created by the forming rods with the package material gripped under tension. One or more pairs of centre hot sealers move in opposite directions to make a center seal. In an embodiment, each pair of centre sealers are mounted on each package material roll line. The package material is cut once the sealing at the centre is completed and the centre sealed packed object arrives for side sealing which are located at a fixed location. The infeeder then moves back to corresponding default position, simultaneously the material gripping system immediately grips the cut paper and pulls down under tension. The material gripping system grips the cut paper simultaneously for the next packaging cycle, as the centre sealed packed object arrives for side sealing which are located at a fixed location. At the side sealing location, the bottom and top sealers move simultaneously to equidistance and complete the side sealing. The QC vision system then checks the quality of the package and if the command is to reject the diverter pushes the packaged object to the reject side, else moves out through the exit conveyor.

Referring now to the drawings, and more particularly to FIG. 1 through 7, where similar reference characters denote corresponding features consistently throughout the figures, there are shown preferred embodiments and these embodiments are described in the context of the following exemplary system and/or method.

Reference numerals of one or more components of the autonomous packaging machine as depicted in the FIGS. 1A through 7 is provided in Table 1 below for ease of description:

TABLE 1

| S. NO | NAME OF COMPONENT | REFERENCE NUMERALS |
|---|---|---|
| 1 | Autonomous packaging machine | 100 |
| 2 | Entry barrier | 102 |
| 3 | Infeed conveyor | 104A |
| 4 | Infeed conveyor second roll line | 104B |
| 5 | Object scanning unit | 106 |
| 6 | a first package material roll line | 108A |

TABLE 1-continued

| S. NO | NAME OF COMPONENT | REFERENCE NUMERALS |
|---|---|---|
| 7 | a second package material roll line | 108B |
| 8 | Diverter | 110 |
| 9 | Cross feed conveyor | 112 |
| 10 | Infeeder | 114A |
| 11 | Cross feed conveyor second roll line | 114B |
| 12 | Object placement indication sensor | 116 |
| 13 | Centering unit | 118 |
| 14 | Object pusher unit (OPU) | 120 |
| 15 | Object pusher vertical unit (OPVU) | 120A |
| 16 | Object pusher horizontal unit (OPHU) | 120B |
| 17 | Machine structure frame | 122 |
| 18 | Control panel | 124 |
| 19 | One or more pair of side sealers | 202A-N |
| 20 | Centre sealing and package unit | 402 |
| 21 | Bill insertion unit | 404 |
| 22 | Mandrel | 406 |
| 23 | Web guide roller | 408 |
| 24 | Nip roller | 410 |
| 25 | Web guide unit | 412 |
| 26 | Package material gripping unit | 414 |
| 27 | Vacuum generator | 416 |
| 28 | Pack forming unit | 418A-B |
| 29 | Out feeder | 420 |
| 30 | Exit conveyor | 422 |
| 31 | Bill printer | 424 |
| 32 | Frame above the object placement indication sensor | 426 |
| 33 | Label printer | 428 |
| 34 | Vision-based quality control unit | 430 |
| 35 | Package quality control unit | 432A-B |
| 36 | Centre sealing fluted jaws | 434A-B |
| 37 | Forming rods | 436A-D |
| 38 | Loop control system | 500 |
| 39 | Simulation device | 518 |
| 40 | Cloud | 520 |
| 41 | Line A | 522A |
| 42 | Line B | 522B |

Figure 1B:
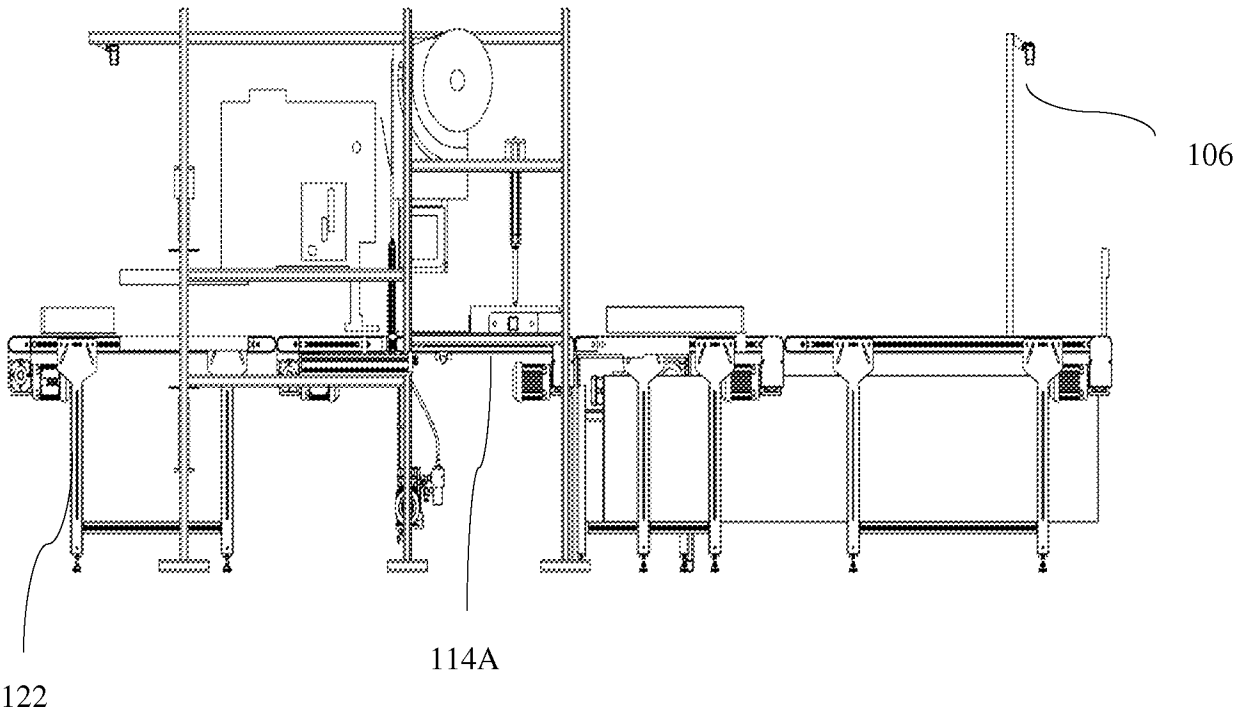
Figure 2A:
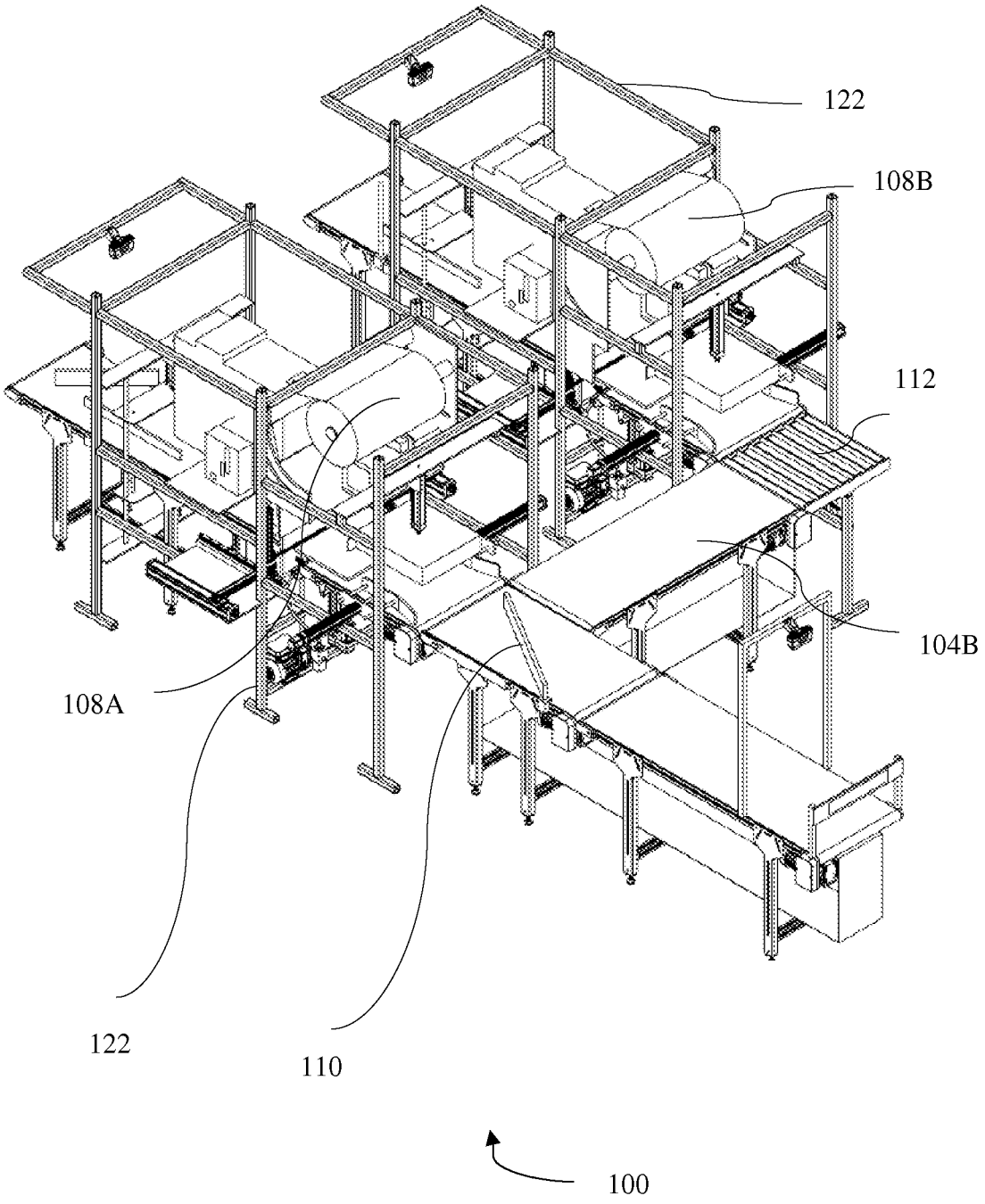
FIG. 2A and FIG. 2B are isometric view and front view respectively of the autonomous packaging machine illustrating an open configuration associated with the infeeder for packaging one or more objects, according to some embodiments of the present disclosure.
Figure 2B:
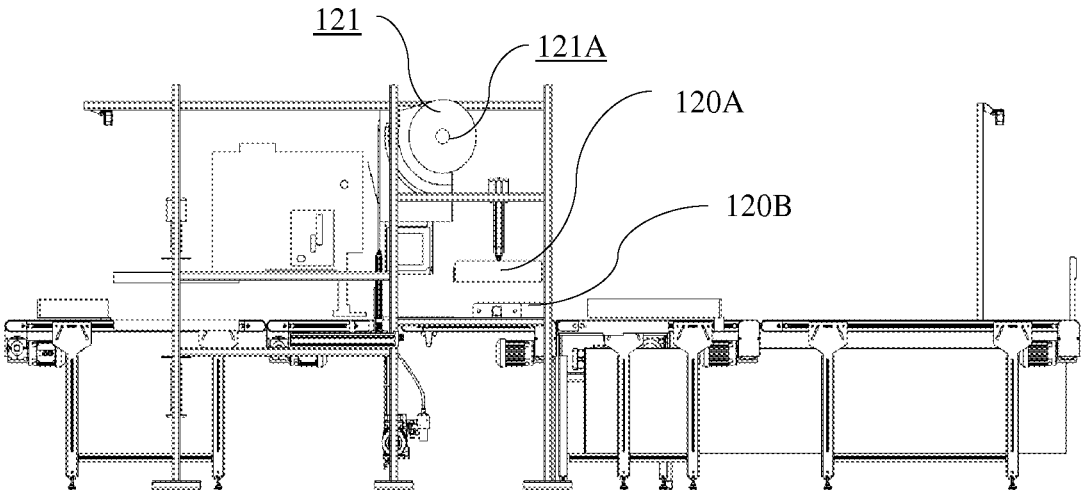
Figure 2C:
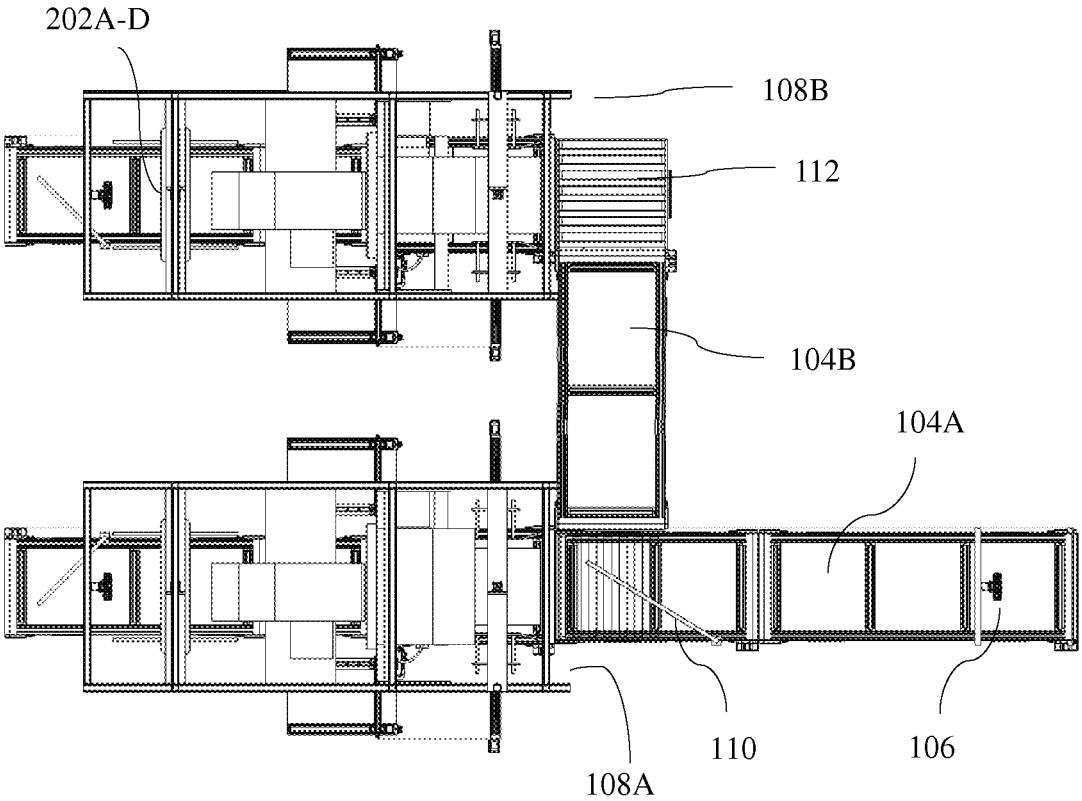
FIG. 2C is a top view of the autonomous packaging machine, according to some embodiments of the present disclosure.
Figure 3:
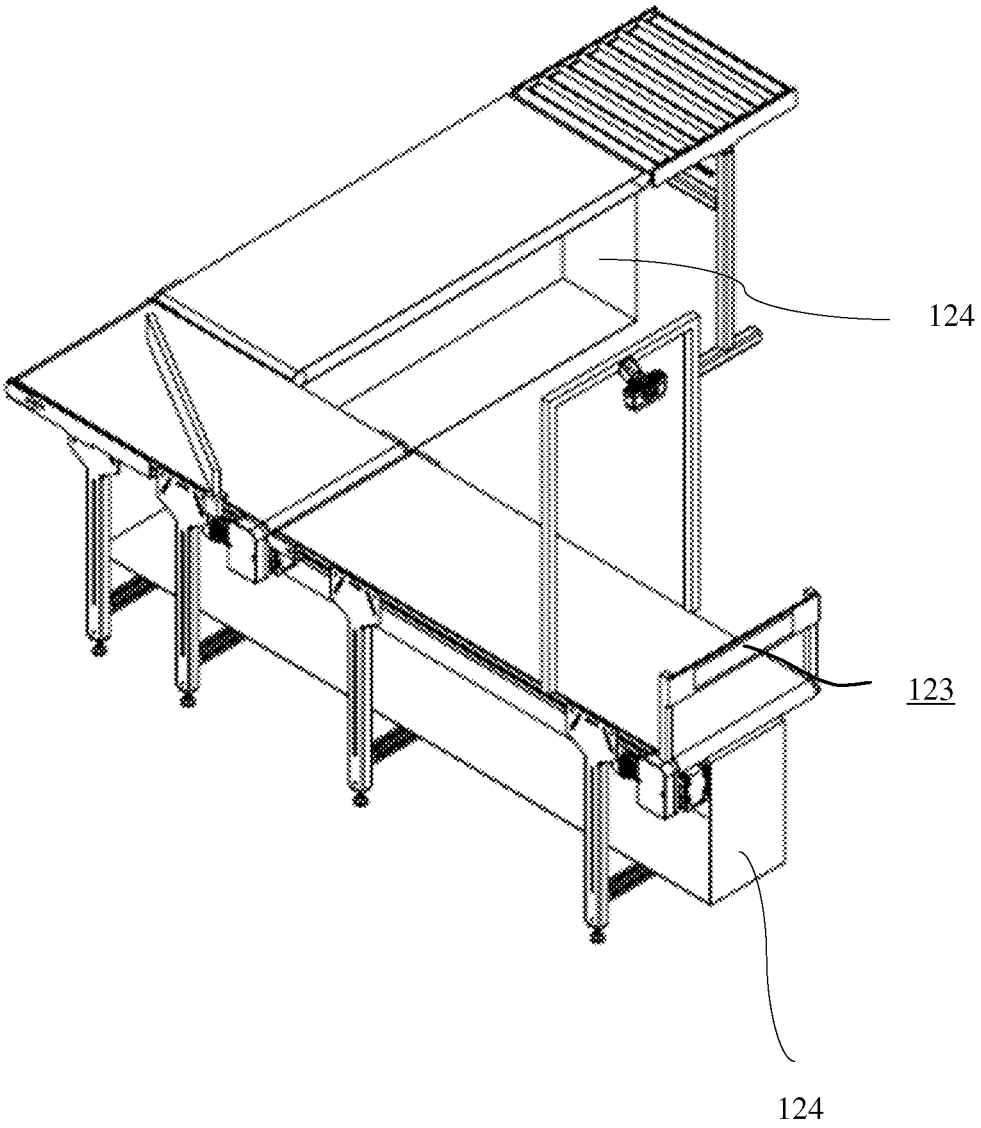
FIG. 3 is an isometric view of the autonomous packaging machine depicting the infeeder, control panel, a diverter with a diverted infeed, according to some embodiments of the present disclosure.
Figure 4A:
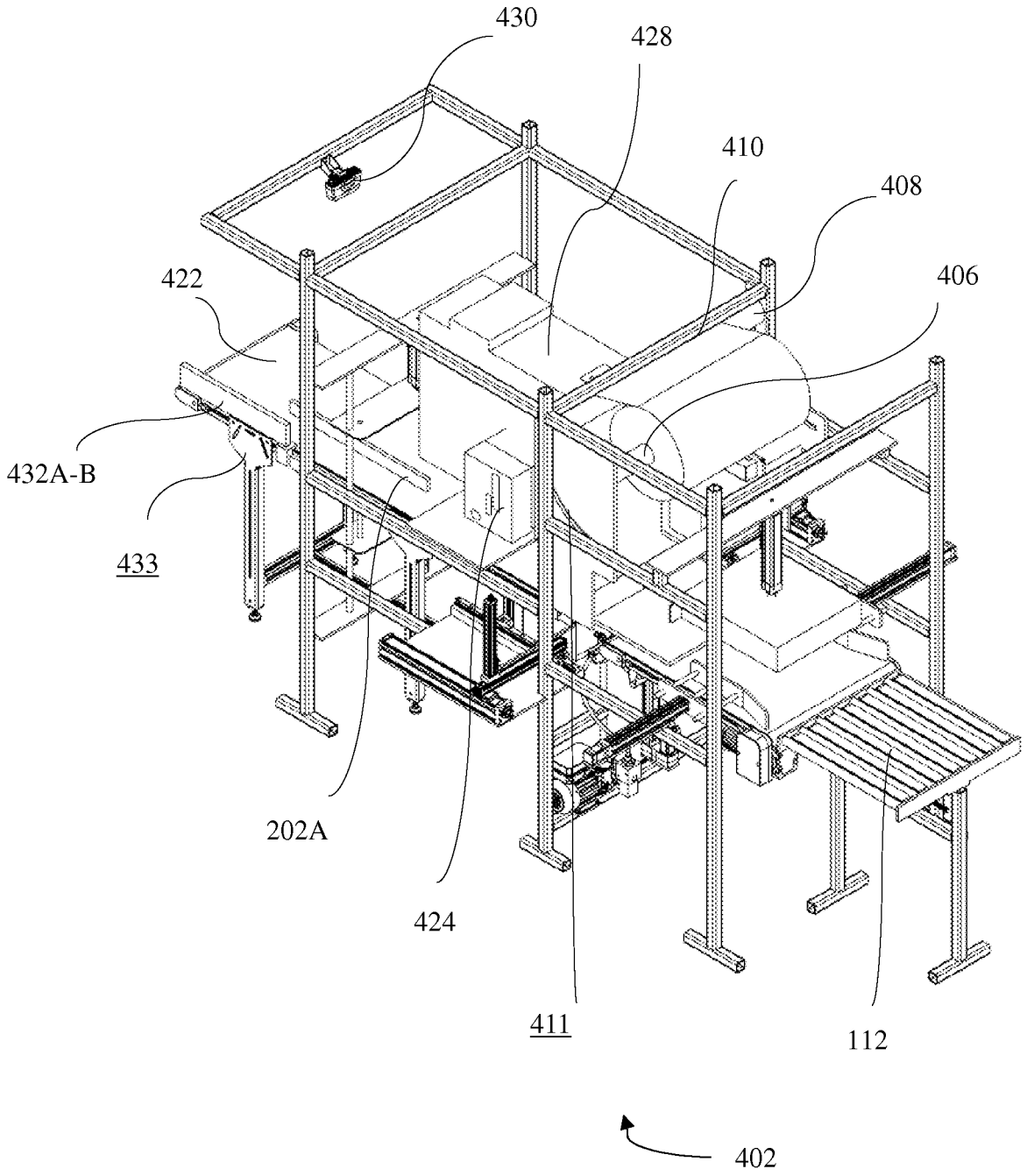
FIG. 4A is an isometric view of a centre sealing and package unit of the autonomous packaging machine, according to some embodiments of the present disclosure.
Figure 4B:
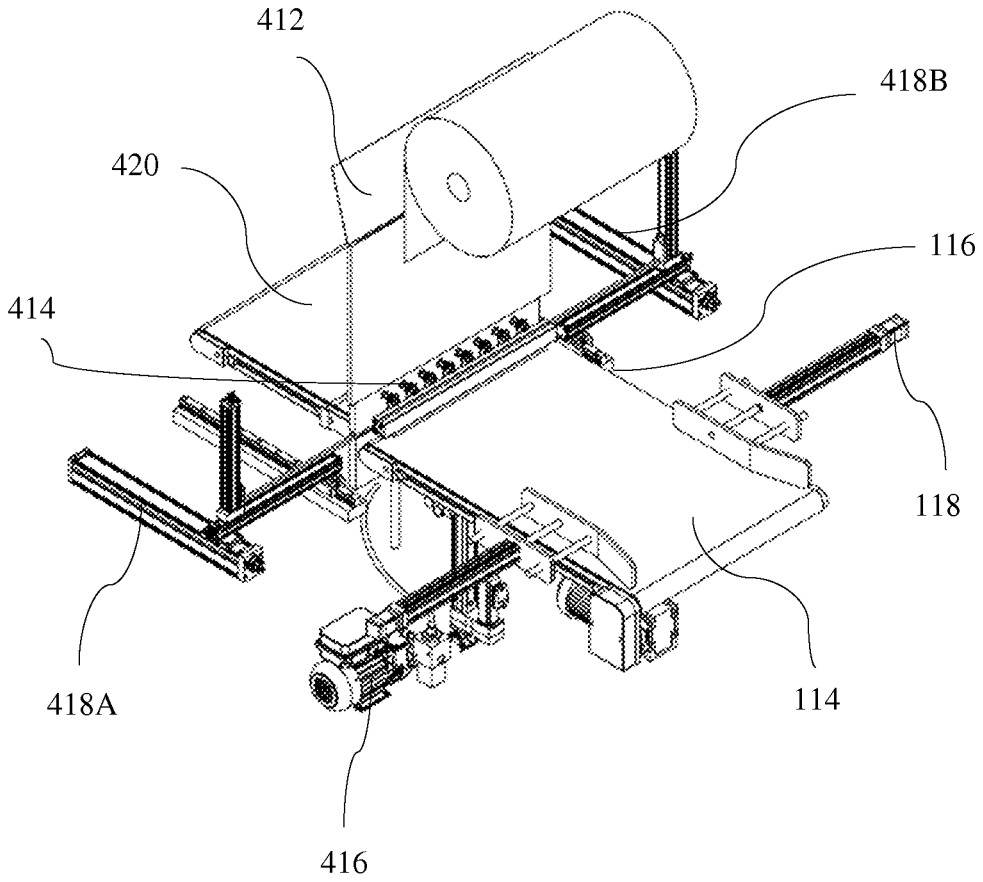
FIG. 4B through FIG. 4F are detailed isometric views of components of the centre sealing and package unit of the autonomous packaging machine, according to some embodiments of the present disclosure.
Figure 4C:
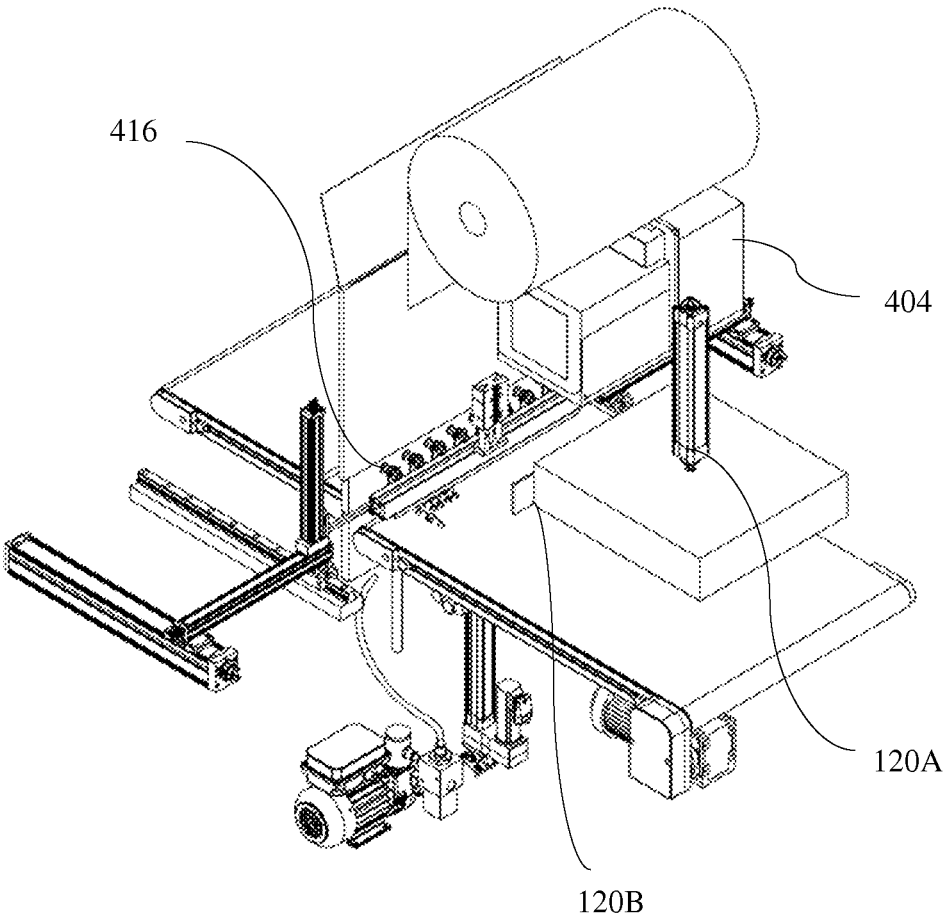
Figure 4D:
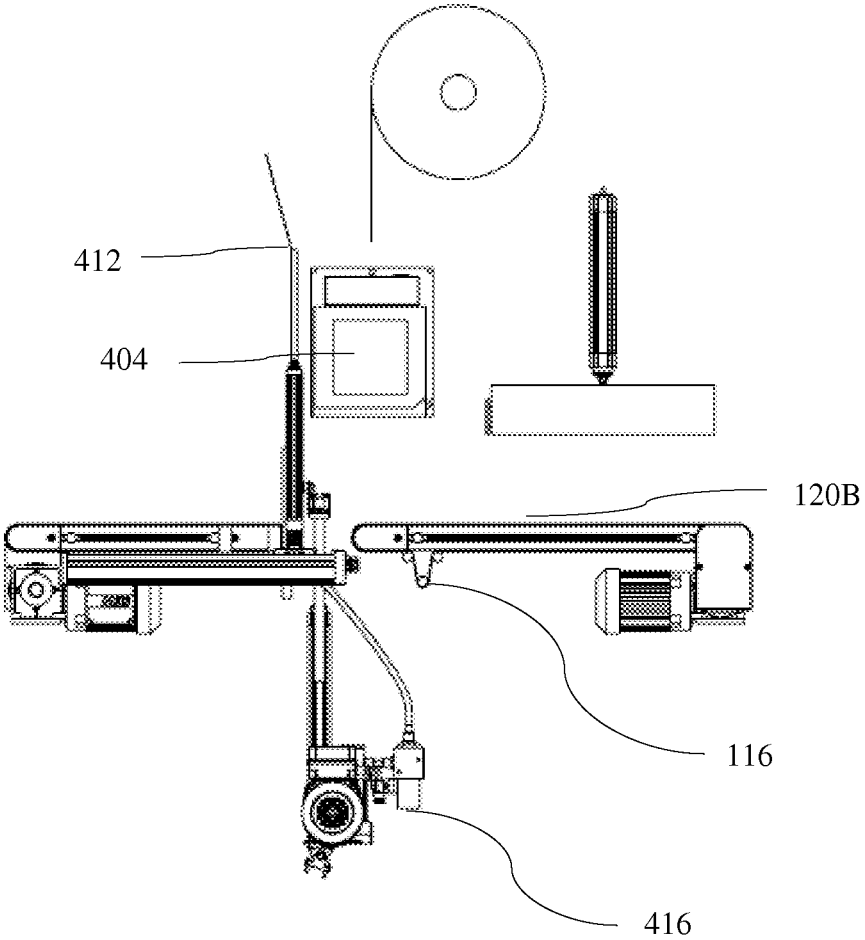
Figure 4E:
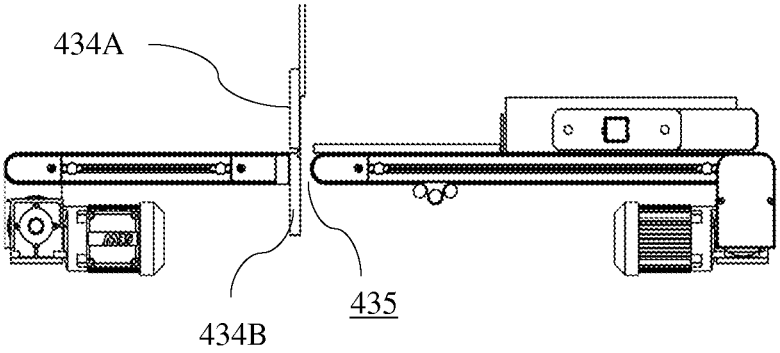
Figure 4F:
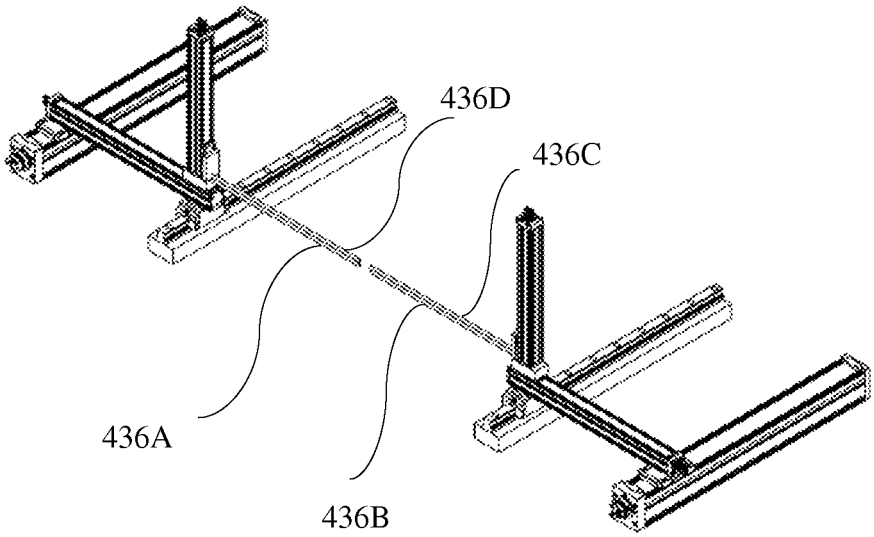

FIG. 1A and FIG. 1B are isometric view and front view respectively illustrating a closed configuration associated with the infeeder 114A of the autonomous packaging machine 100 for packaging one or more objects, according to some embodiments of the present disclosure. FIG. 2A and FIG. 2B are isometric view and front view respectively of the autonomous packaging machine 100 illustrating an open configuration associated with the infeeder 114A for packaging one or more objects, according to some embodiments of the present disclosure. FIG. 2C is a top view of the autonomous packaging machine 100, according to some embodiments of the present disclosure. FIG. 3 is an isometric view of the autonomous packaging machine 100 depicting the infeeder 114A, control panel 124, the diverter 110 with a diverted infeed, according to some embodiments of the present disclosure. FIG. 4A is an isometric view of the centre sealing and package unit 402 of the autonomous packaging machine 100, according to some embodiments of the present disclosure. FIG. 4B through FIG. 4F are detailed isometric views of components of the centre sealing and package unit 402 of the autonomous packaging machine 100, according to some embodiments of the present disclosure. FIG. 6A through FIG. 6D are isometric views that illustrate the working mechanism of the autonomous packaging machine 100 to pack one or more objects, according to some embodiments of the present disclosure. The autonomous packaging machine 100 includes the entry barrier 102 associated with a marker 123, allows one or more objects to be conveyed on an infeed conveyor 104A based on one or more parameters associated with one or more objects. The one or more parameters correspond to: (i) width, and (ii) height. The one or more parameters are required to calculate quantity of packaging material 121 required for a pack, actuation of one or more forming rods 436A-D, and actuation of the object pusher unit (OPU) 120 respectively. The one or more objects are scanned by an object scanning unit 106 to determine the one or more parameters. The associated marker of the entry barrier 102 assists to position the one or more objects centrally on the infeed conveyor 104A. The entry barrier 102 reject any object beyond the width and height of the barrier from entering.

The one or more objects are conveyed by the infeed conveyor 104A. The one or more package material roll lines 108A-N to which the one or more objects are conveyed through the infeed conveyor 104A. In an embodiment, the one or more package material roll lines 108A-N corresponds to but not limited to: (i) a first package material roll line 108A, and (ii) a second package material roll line 108B. In an embodiment, a material roll with a higher roll width for longer objects is allowed to be conveyed in the first package material roll line 108A. For example, length, width, and height combination exceeds a pre-determined value. Similarly, a material roll with a smaller roll width for other objects is diverted by the diverter 110 on the cross feed conveyor 112. The diverter 110 actuates one or more objects autonomously based on associated length. In an embodiment, the diverter 110 is actuated by a pneumatic actuator.

The infeeder 114A is a dancing belt design to move in outward and inward direction. The movement of the infeeder 114A in the outward direction creates a recess 435 for the package material gripping unit 414 to move up and down. The movement of the infeeder 114A in the inward direction close the recess to carry forward the one or more objects in the one or more package material roll lines 108A-B conveyed through the infeed conveyor 104A. The one or more objects is stopped by the object placement indication sensor 116 at the end of the infeeder 114A. The centering unit 118 includes two centering actuators being moved in opposing directions to align the one or more objects symmetrically about a central line of a tensioned package material. A tensioned packaging material cavity is created by one or more forming rods 436A-D based on a measured dimension. In an embodiment, a measured dimension corresponds to but not limited to length, height, and width. The one or more objects are pushed into the tensioned packaging material cavity by the object pusher unit (OPU) 120. The object pusher unit (OPU) 120 includes the first actuator 120A, and the second actuator 120B. The first actuator 120A corresponds to the object pusher vertical unit (OPVU) 120A, and the second actuator 120B corresponds to the object pusher horizontal unit (OPHU) 120B respectively. The first actuator 120A is in an upward position which is a default configuration allowing the one or more objects to pass through to the infeeder 114A. The first actuator 120A is moved vertically down till the level of the infeeder 114A and the one or more objects are pushed by the second actuator 120B based on a measured dimension associated with the one or more objects scanned through the object scanning unit 106. The measured dimension corresponds to the width of the one or more objects passing the entry barrier 102. A stroke length upward and downward is always fixed for the first actuator 120A.

The bill insertion unit 404 which includes the bill printer 424. The bill printer 424 is configured to print the bill and drops over one or more objects. The mandrel 406 is pneumatically expandable to hold a core 121A of the packaging material. The mandrel 406 can be rotated in a clockwise (CW) direction, or a counterclockwise (CCW) direction respectively. The web guide roller 408 moves in a pre-defined arc carrying a tail of a package material roll to align between the web guide roller 408 and the nip roller 410. The nip roller 410 provides additional friction for a material to be packaged. The web guide unit 412 guides the aligned tail of the package material roll in a slot 411 for the package material to be fed without wrinkles. The package material gripping unit 414 includes one or more vacuum grippers to firmly grip the material against a movement of the one or more forming rods 436A-D. The vacuum generator 416 generates enough vacuum for every gripping stroke. In an embodiment, the one or more vacuum grippers hold the packaging material through a suction.

The bill insertion unit 404 which includes the bill printer 424. The bill printer 424 is configured to print the bill and drops over one or more objects. The mandrel 406 is pneumatically expandable to hold a core of the packaging material. The mandrel 406 can be rotated in a clockwise (CW) direction, or a counterclockwise (CCW) direction respectively. The web guide roller 408 moves in a pre-defined arc carrying a tail of a package material roll to align between the web guide roller 408 and the nip roller 410. The nip roller 410 provides additional friction for a material to be packaged. The web guide unit 412 guides the aligned tail of the package material roll in a slot for the package material to be fed without wrinkles. The package material gripping unit 414 includes one or more vacuum grippers to firmly grip the material against a movement of the one or more forming rods 436A-D. The vacuum generator 416 generates enough vacuum for every gripping stroke. In an embodiment, the one or more vacuum grippers hold the packaging material through a suction.

The centre sealing and package unit 402 includes one or more hot sealing jaws with one or more fluted jaws 434A-B to press the package material and to seal at centre with the one or more objects placed inside. The centre sealing and package unit 402 includes one or more pairs of centre hot sealers move-in opposite directions to make a center seal. In an embodiment, each pair of centre sealers are mounted on each package material roll line. The sealing depends on the temperature, pressure applied by the two hot sealing jaws on the material, and dwell time. For example, the two hot sealing jaws are made of stainless steel. Suitable flutes are generated on each jaw to ensure passage of air from the formed pack, and the duration of such temperature and pressure being applied, which is referred to as the dwell time. The pack forming unit 418A-B includes a set of actuators and one or more forming rods 436A-D. The one or more forming rods 436A-D together with the one or more hot sealing jaws with one or more fluted jaws 434A-B create a hollow brick type cavity for the package. In an embodiment, one or more forming rods 436A-D ensure cuboid shape of the pack. The top and bottom forming rods 436A-D splits into two parts to move vertically based on height of the one or more objects and then moved horizontally based on width of the one or more objects. In an embodiment, the one or more forming rods 436A-D are withdrawn and move back to the default position once the centre sealing is performed. The default position corresponds to the beginning of the out feeder 420.

The out feeder 420 carries one or more centre sealed packed objects from the infeeder 114A or 114B to an exit conveyor 422. The exit conveyor 422 is a last conveyor which takes the one or more centre sealed packed objects to centre of one or more pair of side sealers 202A-N mounted on corresponding frame 433 to seal the one or more objects. In an exemplary embodiment, one or more pairs of side sealers 202A-N corresponds to but not limited to: a first pair of side sealers 202A-B, and a second pair of side sealers 202C-D (as depicted in FIG. 2C and FIG. 4A). The label printer 428 is located behind the web guide unit 412 which is configured to stick an associated printed label over each centre sealed packed object. The associated printed label corresponds to an identifier associated with each package. In an embodiment, quality of the associated printed label is validated by the vision-based quality control unit 430. The one or more pair of side sealers 202A-D includes a set of four hot sealers for sealing on both side of a formed pack. In an embodiment, each pair of top and bottom sealers respectively are placed on edge of the package in a fixed location. The top and bottom sealers 202A-D move towards each other during sealing by an equidistant for sealing and move back to the default location after sealing. The bill printer 424 is located below the mandrel 406 on the machine structure frame 122 which allow positioning an associated printed bill over each object. The package quality control unit 432A-B which allows one or more qualified packages to pass through the exit conveyor 422. The vision-based quality control unit 430 also checks the quality of the package and if the command is to reject the diverter 110 pushes the packaged object to the reject side, else moves out through the exit conveyor 422. The control panel 124 is strategically placed for space consideration, heat dissipation, and accessibility. The machine structure frame 122 is created with industrial safety norms to avoid any hazards.

Figure 5:
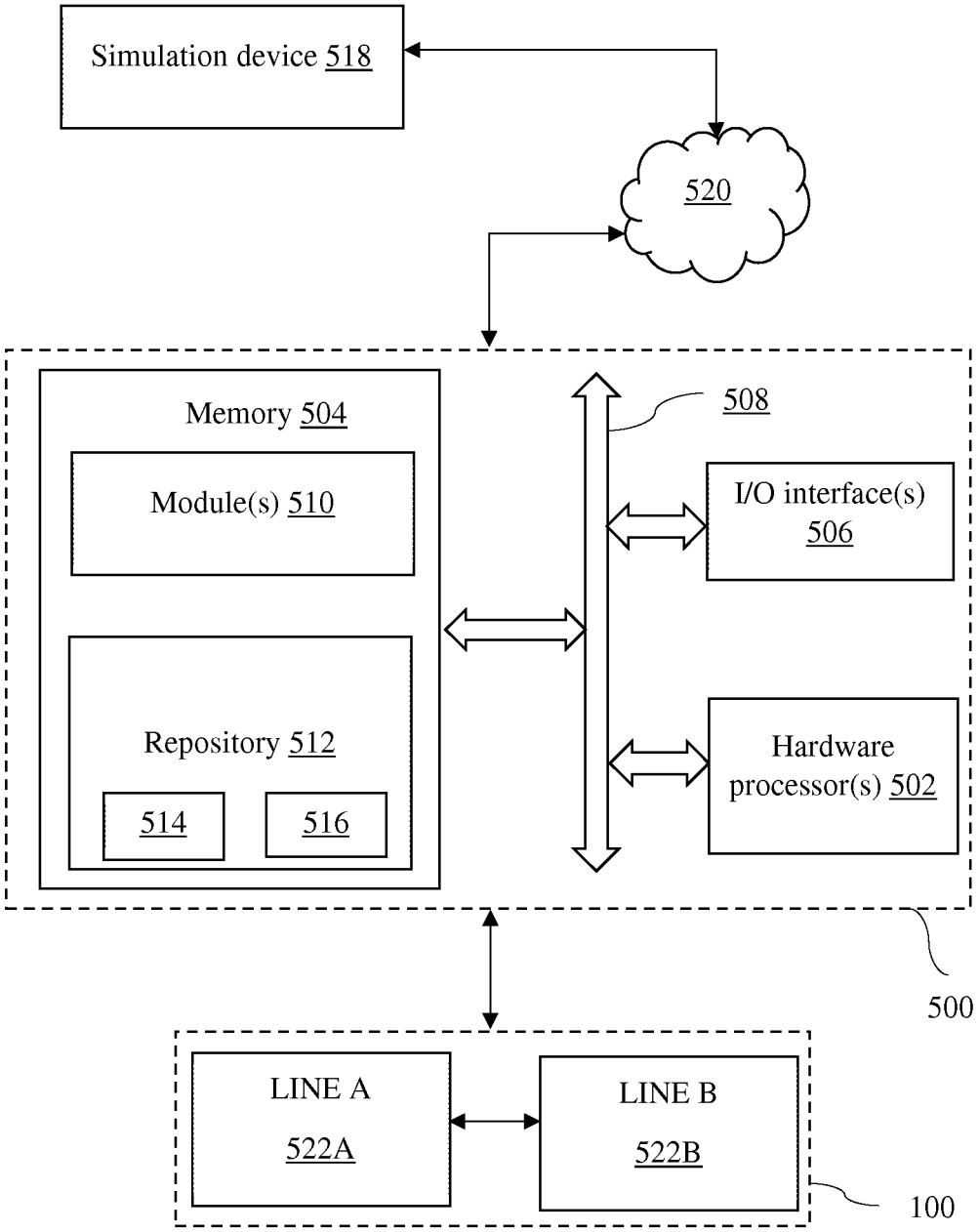
FIG. 5 illustrates a schematic view of loop control system for the autonomous packaging machine of FIG. 1A, according to embodiments of the present disclosure.
Figure 6A:
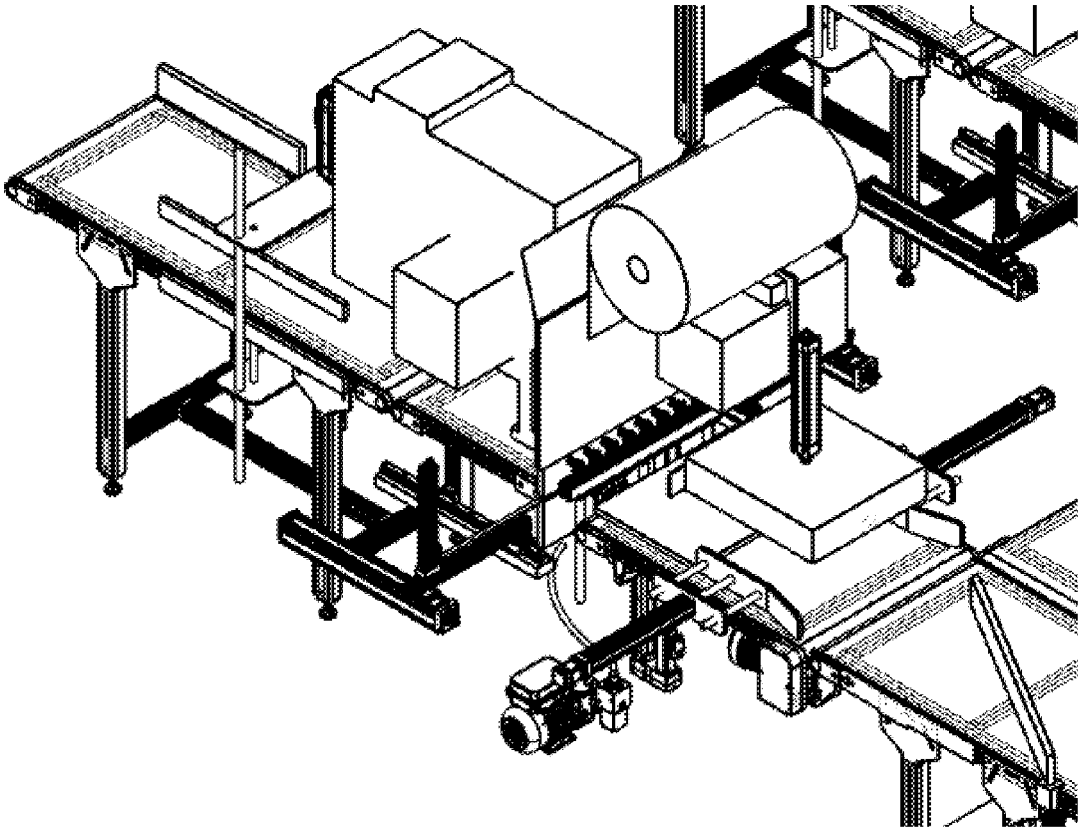
FIG. 6A through FIG. 6D are isometric views that illustrate the working mechanism of the autonomous packaging machine to pack one or more objects, according to some embodiments of the present disclosure.
Figure 6B:
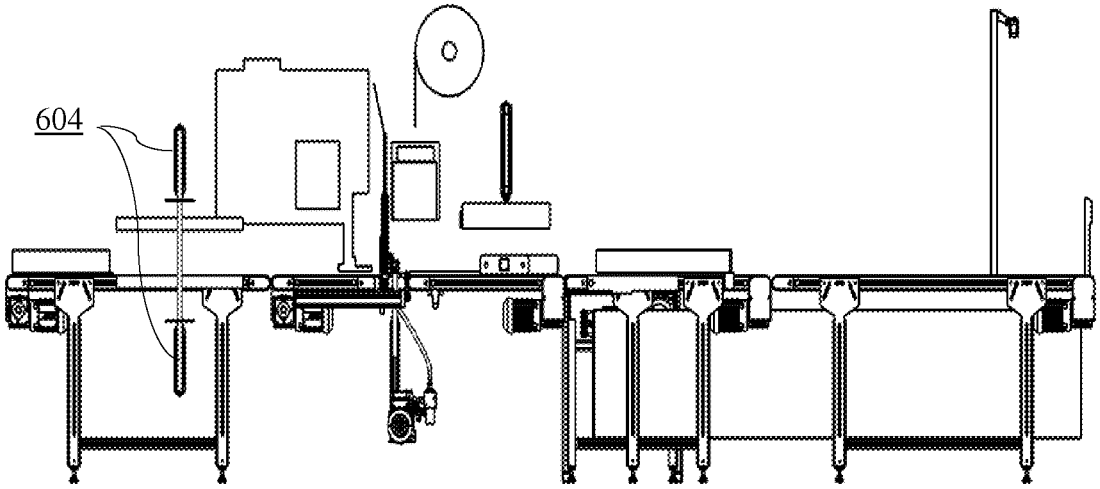
Figure 6C:
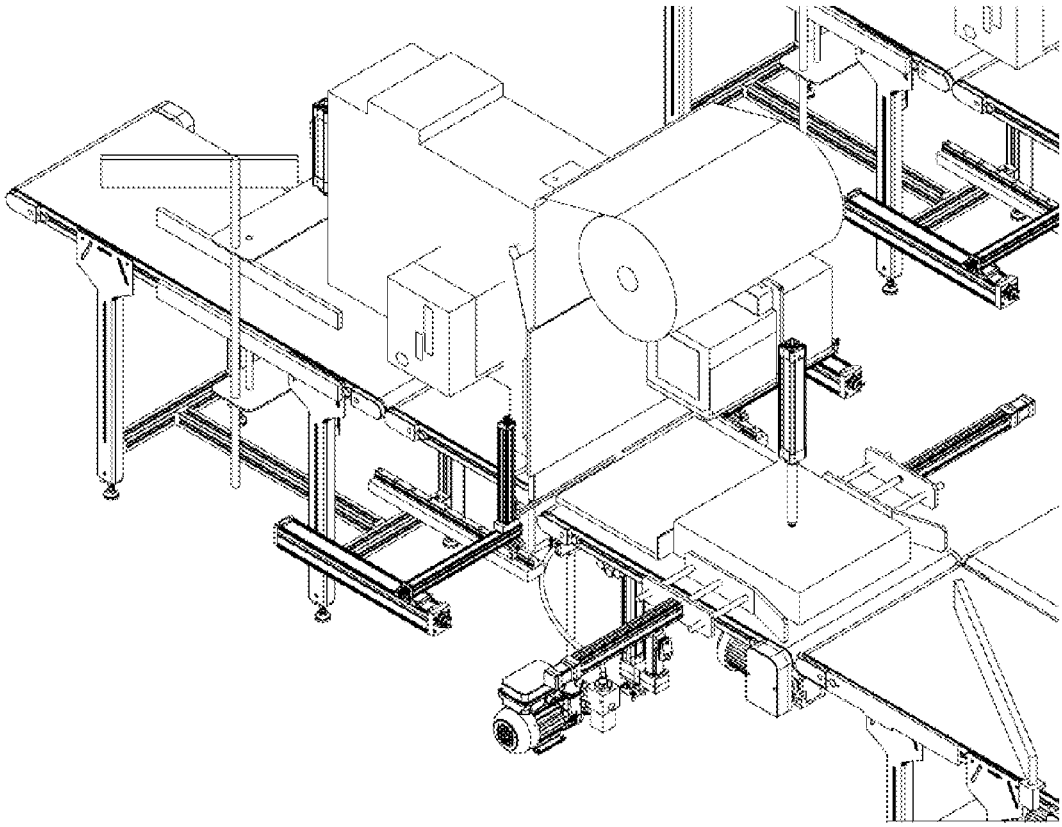
Figure 6D:
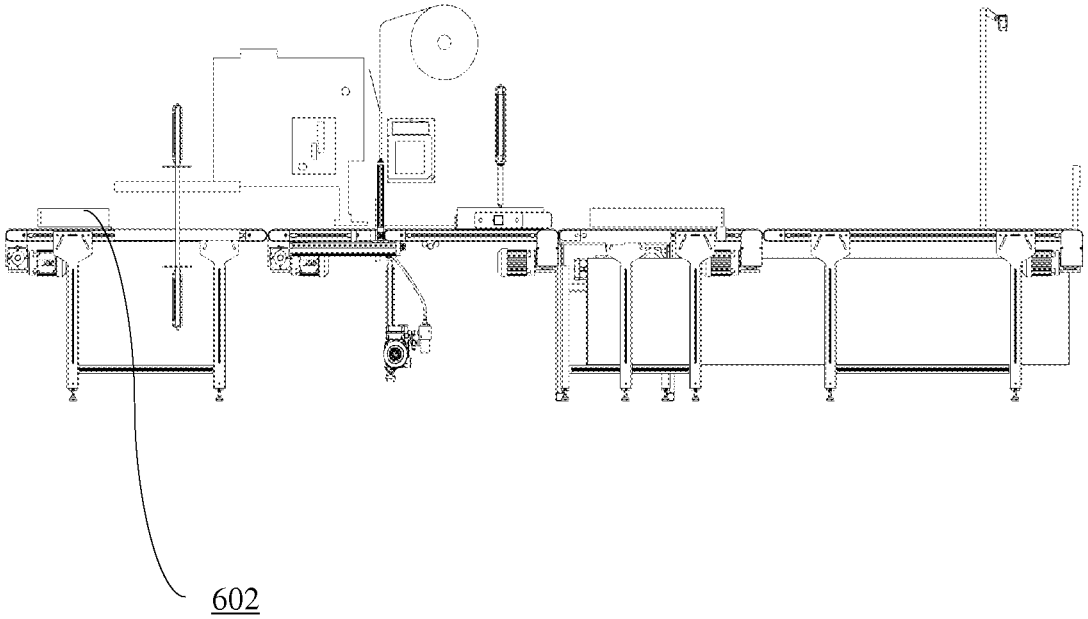

FIG. 5 illustrates a schematic view of loop control system 500 for the autonomous packaging machine 100 of FIG. 1A, according to embodiments of the present disclosure. In an embodiment, the system 500 includes one or more processor(s) 502, communication interface device(s) or input/output (I/O) interface(s) 506, and one or more data storage devices or memory 504 operatively coupled to the one or more processor(s) 502. The memory 504 includes a database. The one or more processor(s) 502, the memory 504, and the I/O interface(s) 506 may be coupled by a system bus such as a system bus 508 or a similar mechanism. The one or more processor(s) 502 that are hardware processors can be implemented as a one or more microprocessors, microcomputers, microcontrollers, digital signal processors, central processing units, state machines, logic circuitries, and/or any devices that manipulate signals based on operational instructions. The one or more processor(s) 502 is configured to control the flow of material/object in one or more conveyors, pack them and exit. A central processing unit (CPU) unit is configured to compute and process sensor signals and command the drives according to the programmed logic. A human machine interface (HMI) unit is configured to aid in manual control. The control unit also includes a switch unit e.g., limit switches. The switch unit is configured to distribute the commands amongst the various motor drives for various actuations. The one or more processor(s) 502 can also implemented as programmable logic controllers (PLCs) i.e., industrial computers, with various inputs and outputs, used to control and monitor industrial equipment based on custom programming. Among other capabilities, the one or more processor(s) 502 is configured to fetch and execute computer-readable instructions stored in the memory 504. In an embodiment, the system 500 can be implemented in a variety of computing systems, such as laptop computers, notebooks, hand-held devices, workstations, mainframe computers, servers, a network cloud, and the like.

The I/O interface device(s) 506 can include a variety of software and hardware interfaces, for example, a web interface, a graphical user interface, and the like. The I/O interface device(s) 506 may include a variety of software and hardware interfaces, for example, interfaces for peripheral device(s), such as a keyboard, a mouse, an external memory, a camera device, and a printer. Further, the I/O interface device(s) 506 may enable the system 500 to communicate with other devices, such as web servers and external databases. The I/O interface device(s) 506 can facilitate multiple communications within a wide variety of networks 520 and protocol types, including wired networks, for example, local area network (LAN), cable, etc., and wireless networks, such as Wireless LAN (WLAN), cellular, or satellite. In an embodiment, the I/O interface device(s) 506 can include one or more ports for connecting a number of devices to one another or to another server.

The memory 504 may include any computer-readable medium known in the art including, for example, volatile memory, such as static random-access memory (SRAM) and dynamic random-access memory (DRAM), and/or non-volatile memory, such as read only memory (ROM), erasable programmable ROM, flash memories, hard disks, optical disks, and magnetic tapes. In an embodiment, the memory 504 includes a plurality of modules 510 and a repository 512 for storing data processed, received, and generated by the plurality of modules 510. The plurality of modules 510 may include routines, programs, objects, components, data structures, and so on, which perform particular tasks or implement particular abstract data types.

Further, the database stores information pertaining to inputs fed to the system 500 and/or outputs generated by the system (e.g., data/output generated at each stage of the data processing) 500, specific to the methodology described herein. More specifically, the database stores information being processed at each step of the proposed methodology.

Additionally, the plurality of modules 510 may include programs or coded instructions that supplement applications and functions of the system 500. The repository 512, amongst other things, includes a system database 514 and other data 516. The other data 516 may include data generated as a result of the execution of one or more modules in the plurality of modules 510. Further, the database stores information pertaining to inputs fed to the system 500 and/or outputs generated by the system (e.g., at each stage), specific to the methodology described herein. Herein, the memory for example the memory 504, and the computer program code configured to, with the hardware processor, for example the processor 502, causes the system 500 to perform various functions described herein under. The system 100 includes a line A 522A, and line B 522B. The line A 522A, and the line B 522B further includes sealers/cutters, several sensors, actuators, and conveyors. The one or more sensors may correspond to one or more proximity sensors, weight sensors, position sensors which give essential feedback.

Figure 7:
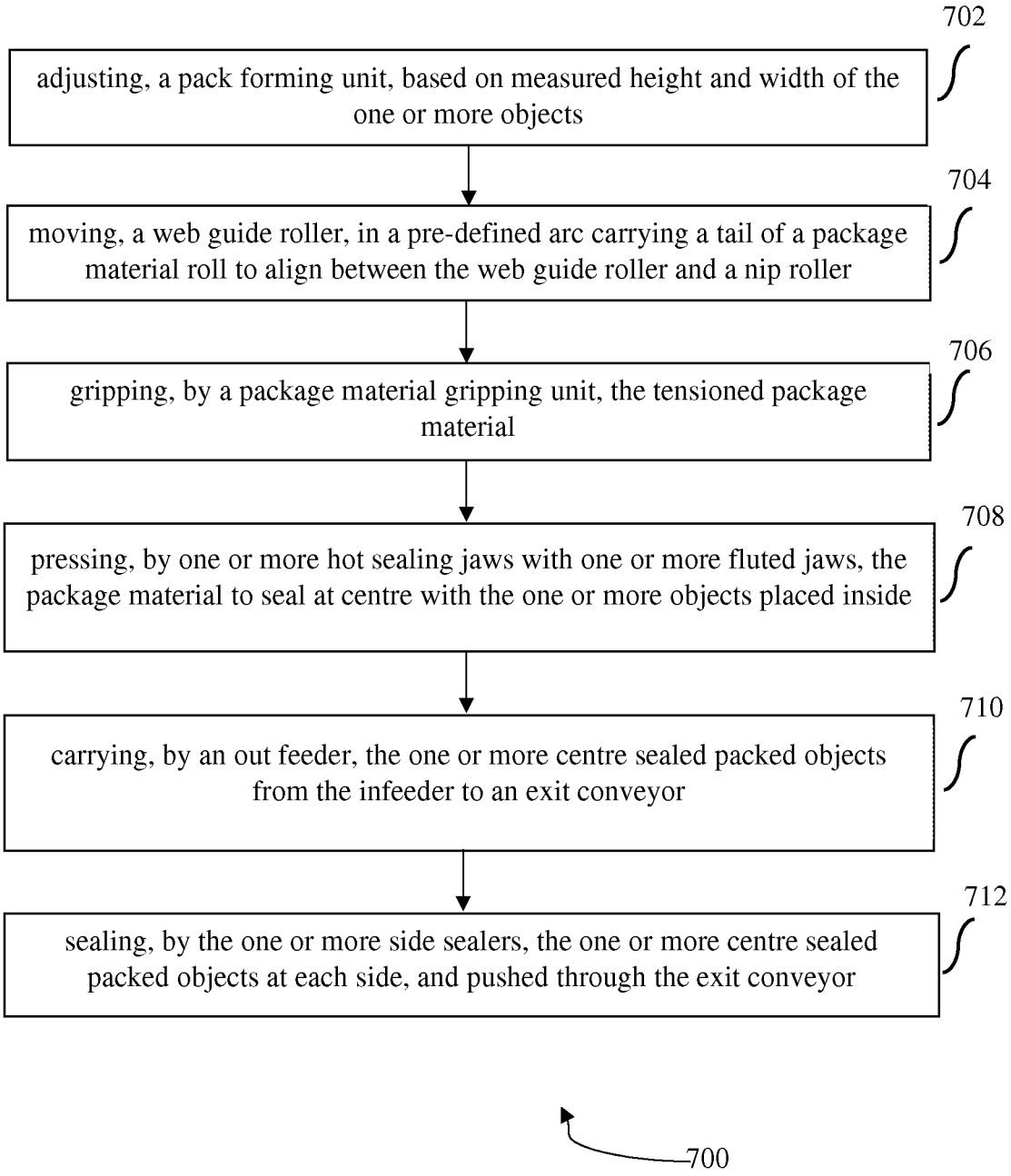
FIG. 7 is a flow diagram illustrating a method of packaging one or more objects at the autonomous packaging machine, according to some embodiments of the present disclosure.

FIG. 7 is a flow diagram illustrating a method 700 of packaging one or more objects at the autonomous packaging machine 100, according to some embodiments of the present disclosure. In an embodiment, the loop control system 500 comprises one or more data storage devices or the memory 504 operatively coupled to the one or more hardware processors 502 and is configured to store instructions for execution of steps of the method by the one or more processors 502. The flow diagram depicted is better understood by way of following explanation/description. The steps of the method of the present disclosure will now be explained with reference to the components of the system as depicted in FIGS. 1A-7.

At step 702 of the present disclosure, a pack forming unit (418A-B) is adjusted based on measured height and width of the one or more objects. The infeeder 114A is relocated to a default position. The pack forming unit 418A-B includes a set of actuators and one or more forming rods 436A-D. The one or more forming rods 436A-D together with the one or more hot sealing jaws with one or more fluted jaws 434A-B create a hollow brick type cavity for the package. At step 704 of the present disclosure, the web guide roller 408 is moved in a pre-defined arc carrying a tail of a package material roll to align between the web guide roller 408 and the nip roller 410. The nip roller 410 provides additional friction for a material to be packaged. The web guide unit 412 guides the aligned tail of the package material roll in a slot for the package material without wrinkles. The mandrel 406 is pneumatically expandable to hold a core of the packaging material. The mandrel 406 can be rotated in a clockwise (CW) direction, or a counterclockwise (CCW) direction respectively. At step 706 of the present disclosure, the tensioned package material is gripped, by the package material gripping unit 414. The package material gripping unit 414 includes one or more vacuum grippers to firmly grip the material against a movement of the one or more forming rods 436A-D. In an embodiment, enough vacuum for every gripping stroke is generated by the vacuum generator 416. At step 708 of the present disclosure, the package material is pressed by one or more hot sealing jaws with one or more fluted jaws 434A-B, to seal at centre with the one or more objects placed inside. The sealing depends on temperature, pressure applied by the two hot sealing jaws on the material, and dwell time. At step 710 of the present disclosure, the one or more centre sealed packed objects from the infeeder 114A or the infeeder 114B carried by the out feeder 420 to an exit conveyor 422. The exit conveyor 422 is a last conveyor which takes the one or more centre sealed packed objects to centre of one or more pair of side sealers 202A-D mounted on corresponding frame to seal the one or more objects. At step 712 of the present disclosure, the one or more centre sealed packed objects are sealed at each side by the one or more pair of side sealers 202A-D and pushed through the exit conveyor 422. The one or more pair of side sealers 202A-D include a set of four hot sealers for sealing on both sides of a formed pack. In an embodiment, each pair with top and bottom sealers are placed on edge of the package in a fixed location.

At step 714 of the present disclosure, an associated printed bill is positioned by the bill printer 424 over each object. The bill printer 424 is located below the mandrel 406 on the machine structure frame 122. At step 714 of the present disclosure, an associated printed label is stuck by the label printer 428, over each package. The label printer 428 is located behind the web guide unit 412. The associated printed label corresponds to an identifier associated with each package. In an embodiment, quality of the associated printed label is validated by the vision-based quality control unit 430. At step 714 of the present disclosure, one or more qualified packages is allowed by the package quality control unit 432A-B, to pass through the exit conveyor 422.

In an embodiment, one or more objects are scanned by the object scanning unit 106 to determine the one or more parameters. In an embodiment, the one or more parameters correspond to: (i) width, and (ii) height. In an embodiment, the one or more parameters are required to calculate quantity of packaging material required for a pack 602, for actuation of the one or more forming rods 436A-D, and actuation of the OPU 120. In an embodiment, a material roll with a higher roll width for longer objects—are allowed to be conveyed in the first package material roll line 108A. In an embodiment, a material roll with a smaller roll width for other objects is diverted by the diverter 110 on the cross feed conveyor 112. In an embodiment, the diverter 110 actuates the one or more objects autonomously based on associated length, and wherein the diverter 110 is actuated by a pneumatic actuator 604. In an embodiment, the first actuator 120A corresponds to the object pusher vertical unit (OPVU) 120A, and the second actuator 120B corresponds to the object pusher horizontal unit (OPHU) 120B respectively. In an embodiment, the first actuator 120A is in an upward position which is a default configuration allowing the one or more objects to pass through to the infeeder 114A. In an embodiment, the first actuator 120A is moved vertically down till the level of the infeeder 114A, and the one or more objects are pushed by the second actuator 120B based on a measured dimension associated with the one or more objects scanned through the object scanning unit 106. In an embodiment, a stroke length upward and downward is always fixed for the first actuator 120A.

In an embodiment, top and bottom forming rods 436A-D split into two parts to move vertically based on height of the one or more objects and then moved horizontally based on width of the one or more objects. In an embodiment, the one or more forming rods 436A-D are withdrawn and move back to the default position once the centre sealing is performed. In an embodiment, the default position corresponds to the front end of the out feeder 420. In an embodiment, the top and bottom sealers 202A-D move towards each other during sealing by an equidistant for sealing and move back to the default location after sealing. In an embodiment, the bill printer 424 is located below the mandrel 406 on the machine structure frame 122 which allows to position an associated printed bill over each object. In an embodiment, the label printer 428 is located behind the web guide unit 412 which allows to stick an associated printed label over each package. In an embodiment, the associated printed label corresponds to an identifier associated with each package. In an embodiment, the quality of the associated printed label is validated by the vision-based quality control unit 430. In an embodiment, the package quality control unit 432A-B which allows one or more qualified packages to pass through the exit conveyor 422.

The embodiment of present disclosure herein addresses unresolved problems of end of line packaging for customized packing with respect to the dimension of the objects. The autonomous packaging machine is an end of line packaging (EOL) system, intended for packing objects with a form-fill and three-side sealing method using a sustainable packaging material. The customization of packing material with respect to the width and height of the one or more objects. The autonomous packaging machine utilizes forming rods to create a hollow brick type cavity of packaging material based on the width and height of the object. The length of the objects is always aligned to the fixed roll width. The autonomous packaging machine employs various actuators, conveyors, and sensors to create a custom package for the object. The autonomous packaging machine using foldable and the sustainable material (e.g., paper) for each object and seals the package completely to create the custom package for the object. The sustainable packaging material up to a thickness of 70-90 GSM. The dancing belt conveyor of the autonomous packaging machine allow smaller width objects also to be packaged and maintains a high throughput. The measured object dimensions are used intelligently for creating the package structure. Also, a vision system to measure the quality of the package and to accept or reject. The autonomous packaging machine provides an assisted automated loading of package rolls. The throughput can be as high as 900 packages/hr. The tailor-made package produced by the autonomous packaging machine saves package material and in turn yields better return on investment (ROI). The autonomous packaging machine can handle two packaging rolls in Line 1 and Line 2. The object to be packaged is passed through an entry barrier, which denies entry to object beyond the defined height and width. The autonomous packaging machine can save nearly 18% packing material compared to that of the preformed packs with a throughput of 900 packs/hour with max, 18 hour/day operation, and 4-6 hour/week maintenance. The autonomous packaging machine is capable of pack objects up to a minimum of width of 10 mm and maximum of 480 mm, high throughput, secured sealing, lesser footprint, capability of 20 hours/day operation, lesser noise, minimal maintenance, scalability by adding multiple rolls, modular design, lower opex, better RoI by minimizing packing material wastage etc. The autonomous packaging machine is designed to have noise level less than 80 dbA @ 1 m distance. During centre sealing operation the infeeder takes two configurations to allow the packaging material gripping system (PMGS) to move between the infeeder and the out feeder which allows smaller width objects to be packaged.

The written description describes the subject matter herein to enable any person skilled in the art to make and use the embodiments. The scope of the subject matter embodiments is defined by the claims and may include other modifications that occur to those skilled in the art. Such other modifications are intended to be within the scope of the claims if they have similar elements that do not differ from the literal language of the claims or if they include equivalent elements with insubstantial differences from the literal language of the claims.

It is to be understood that the scope of the protection is extended to such a program and in addition to a computer-readable means having a message therein; such computer-readable storage means contain program-code means for implementation of one or more steps of the method, when the program runs on a server or mobile device or any suitable programmable device. The hardware device can be any kind of device which can be programmed including e.g., any kind of computer like a server or a personal computer, or the like, or any combination thereof. The device may also include means which could be e.g., hardware means like e.g., an application-specific integrated circuit (ASIC), a field-programmable gate array (FPGA), or a combination of hardware and software means, e.g., an ASIC and an FPGA, or at least one microprocessor and at least one memory with software processing components located therein. Thus, the means can include both hardware means, and software means. The method embodiments described herein could be implemented in hardware and software. The device may also include software means. Alternatively, the embodiments may be implemented on different hardware devices, e.g., using a plurality of CPUs.

The embodiments herein can comprise hardware and software elements. The embodiments that are implemented in software include but are not limited to, firmware, resident software, microcode, etc. The functions performed by various components described herein may be implemented in other components or combinations of other components. For the purposes of this description, a computer-usable or computer readable medium can be any apparatus that can comprise, store, communicate, propagate, or transport the program for use by or in connection with the instruction execution system, apparatus, or device.

The illustrated steps are set out to explain the exemplary embodiments shown, and it should be anticipated that ongoing technological development will change the manner in which particular functions are performed. These examples are presented herein for purposes of illustration, and not limitation. Further, the boundaries of the functional building blocks have been arbitrarily defined herein for the convenience of the description. Alternative boundaries can be defined so long as the specified functions and relationships thereof are appropriately performed. Alternatives (including equivalents, extensions, variations, deviations, etc., of those described herein) will be apparent to persons skilled in the relevant art(s) based on the teachings contained herein. Such alternatives fall within the scope of the disclosed embodiments. Also, the words "comprising," "having," "containing," and "including," and other similar forms are intended to be equivalent in meaning and be open ended in that an item or items following any one of these words is not meant to be an exhaustive listing of such item or items or meant to be limited to only the listed item or items. It must also be noted that as used herein and in the appended claims, the singular forms "a," "an," and "the" include plural references unless the context clearly dictates otherwise.

Furthermore, one or more computer-readable storage media may be utilized in implementing embodiments consistent with the present disclosure. A computer-readable storage medium refers to any type of physical memory on which information or data readable by a processor may be stored. Thus, a computer-readable storage medium may store instructions for execution by one or more processors, including instructions for causing the processor(s) to perform steps or stages consistent with the embodiments described herein. The term "computer-readable medium" should be understood to include tangible items and exclude carrier waves and transient signals, i.e., be non-transitory. Examples include random access memory (RAM), read-only memory (ROM), volatile memory, nonvolatile memory, hard drives, CD ROMs, DVDs, flash drives, disks, and any other known physical storage media.

It is intended that the disclosure and examples be considered as exemplary only, with a true scope of disclosed embodiments being indicated by the following claims.

What is claimed is:

1. An autonomous packaging machine, comprising:

an entry barrier associated with a marker, allows one or more objects to be conveyed on an infeed conveyor based on one or more parameters associated with one or more objects, wherein the associated marker of the entry barrier assists to position the one or more objects centrally on the infeed conveyor;

a plurality of package material roll lines to which the one or more objects are conveyed through the infeed conveyor, wherein the plurality of package material roll lines corresponds to: (i) a first package material roll line, and (ii) a second package material roll line;

an infeeder is a dancing belt design to move in an outward and an inward direction, wherein movement in the outward direction creates a recess for a package material gripping unit to move up and down, wherein movement in the inward direction closes the recess to carry forward the one or more objects in the plurality of package material roll lines conveyed through the infeed conveyor, wherein the one or more objects is stopped by an object placement indication sensor at the end of the infeeder;

a centering unit comprises of two centering actuators being moved in opposing directions to align the one or more objects symmetrically about a central line of a tensioned package material;

wherein a tensioned packaging material cavity is created by one or more forming rods based on a measured dimension, and the one or more objects are pushed into the tensioned packaging material cavity by an object pusher unit (OPU), wherein the object pusher unit (OPU) comprises a first actuator, and a second actuator;

a mandrel is pneumatically expandable to hold a core of the packaging material, wherein the mandrel can be rotated in a clockwise (CW) direction, or a counter-clockwise (CCW) direction respectively;

a web guide roller moves in a pre-defined arc carrying a tail of a package material roll to align between the web guide roller and a nip roller, wherein the nip roller provides an additional friction for a material to be packaged, and wherein a web guide unit guides the aligned tail of the package material roll in a slot for the package material to be fed without wrinkles;

the package material gripping unit comprises of one or more vacuum grippers to firmly grip the material against a movement of the one or more forming rods, and wherein a vacuum generator generates enough vacuum for every gripping stroke;

a center sealing and package unit comprise of one or more hot sealing jaws with one or more fluted jaws to press the package material and to seal at center with the one or more objects placed inside, and wherein the sealing depends on a temperature, a pressure applied by the two hot sealing jaws on the material, and a dwell time;

a pack forming unit comprise of set of actuators and the one or more forming rods, wherein the one or more forming rods together with the one or more hot sealing jaws with one or more fluted jaws create a hollow brick type cavity for the package;

an out feeder carries the one or more center sealed packed objects from the infeeder to an exit conveyor, wherein the exit conveyor is a last conveyor which takes the one or more center sealed packed objects to center of one or more pair of side sealers mounted on a corresponding frame to seal each side the one or more center sealed packed objects; and the one or more pair of side sealers comprises a set of four hot sealers for sealing on both side of a formed pack, wherein each pair with top and bottom sealers are placed on an edge of the formed pack in a fixed location.

2. The autonomous packaging machine of claim 1, wherein the one or more objects are scanned by an object scanning unit to determine the one or more parameters, wherein the one or more parameters corresponds to: (i) a width, and (ii) a height, and wherein the one or more parameters are required to calculate quantity of packaging material required for a pack, for actuation of the one or more forming rods, and actuation of the OPU, wherein a material roll with a higher roll width for longer objects are allowed to be conveyed in the first package material roll line, wherein a material roll with a smaller roll width for other objects are diverted by a diverter on a cross feed conveyor, and wherein the diverter actuates the one or more objects autonomously based on associated length.

3. The autonomous packaging machine of claim 1, wherein the first actuator corresponds to an object pusher vertical unit (OPVU), and the second actuator corresponds to an object pusher horizontal unit (OPHU) respectively, wherein the first actuator is in an upward position which is a default configuration allowing the one or more objects to pass through to the infeeder, wherein, the first actuator is moved vertically down until the level of the infeeder and the one or more objects are pushed by the second actuator based on a measured dimension associated with the one or more objects scanned through the object scanning unit, and wherein a stroke length upward and downward is always fixed for the first actuator.

4. The autonomous packaging machine of claim 1, wherein top and bottom forming rods splits into two parts to move vertically based on height of the one or more objects and then moved horizontally based on width of the one or more objects, wherein the one or more forming rods are withdrawn and move back to the default position, once the center sealing is performed, and wherein the default position corresponds to front end of the out feeder.

5. The autonomous packaging machine of claim 1, wherein the top and bottom sealers move towards each other during sealing by an equidistant for sealing and move back to a default location after sealing.

6. The autonomous packaging machine of claim 1, further comprises a bill printer located below the mandrel on the machine structure frame which allows to position an associated printed bill over each object.

7. The autonomous packaging machine of claim 1, further comprises a label printer is located behind the web guide unit which allows to stick an associated printed label over each package, wherein the associated printed label corresponds to an identifier associated with each package, and wherein quality of the associated printed label is validated.

8. The autonomous packaging machine of claim 7, further comprises a package quality control unit which allows one or more qualified packages to pass through the exit conveyor.

9. A processor implemented method for packaging of one or more objects using an autonomous packaging machine, the autonomous packaging machine comprising:

an entry barrier associated with a marker, allows one or more objects to be conveyed on an infeed conveyor based on one or more parameters associated with one or more objects, wherein the associated marker of the entry barrier assist to position the one or more objects centrally on the infeed conveyor;

a plurality of package material roll lines to which the one or more objects are conveyed through the infeed conveyor, wherein the plurality of package material roll lines corresponds to: (i) a first package material roll line, and (ii) a second package material roll line;

an infeeder is a dancing belt design to move in an outward and an inward direction, wherein movement in the outward direction creates a recess for a package material gripping unit to move up and down, wherein movement in the inward direction closes the recess to carry forward the one or more objects in the plurality of package material roll lines conveyed through the infeed conveyor, wherein the one or more objects is stopped by an object placement indication sensor at the end of the infeeder;

a centering unit comprises of two centering actuators being moved in opposing directions to align the one or more objects symmetrically about a central line of a tensioned package material, wherein a tensioned packaging material cavity is created by one or more forming rods based on a measured dimension, and the one or more objects are pushed into the tensioned packaging material cavity by an object pusher unit (OPU), wherein the object pusher unit (OPU) comprises a first actuator, and a second actuator, the method comprising:

adjusting, a pack forming unit based on measured height and width of the one or more objects, wherein the infeeder is relocated to a default position, wherein the pack forming unit comprise of set of actuators and the one or more forming rods, and wherein the one or more forming rods together with the one or more hot sealing jaws with one or more fluted jaws create a hollow brick type cavity for the package;

moving, a web guide roller, in a pre-defined arc carrying a tail of a package material roll to align between the web guide roller and a nip roller, wherein the nip roller provides an additional friction for a material to be packaged, and wherein a web guide unit guides the aligned tail of the package material roll in a slot for the package material without wrinkles, wherein a mandrel is pneumatically expandable to hold a core of the packaging material, and wherein the mandrel can be rotated in a clockwise (CW) direction, or a counter-clockwise (CCW) direction respectively;

gripping, by the package material gripping unit, the tensioned package material, wherein the package material gripping unit comprises of one or more vacuum grippers to firmly grip the material against a movement of the one or more forming rods, and wherein enough vacuum for every gripping stroke is generated by a vacuum generator;

pressing, by one or more hot sealing jaws with one or more fluted jaws, the package material to seal at center with the one or more objects placed inside, wherein the sealing depends on a temperature, a pressure applied by the two hot sealing jaws on the material, and a dwell time;

carrying, by an out feeder, the one or more center sealed packed objects from the infeeder to an exit conveyor, wherein the exit conveyor is a last conveyor which takes the one or more center sealed packed objects to center of one or more pair of side sealers mounted on corresponding frame to seal the one or more center sealed packed objects; and sealing, by the one or more pair of side sealers, the one or more center sealed packed objects at each side, and pushed through the exit conveyor, wherein the one or more pair of side sealers comprises a set of four hot sealers for sealing on both side of a formed pack, and wherein each pair with top and bottom sealers are placed on edge of the formed pack in a fixed location.

10. The processor implemented method of claim 9, wherein the one or more objects are scanned by an object scanning unit to determine the one or more parameters, wherein the one or more parameters corresponds to: (i) a width, and (ii) a height, and wherein the one or more parameters are required to calculate quantity of packaging material required for a pack, for actuation of the one or more forming rods, and actuation of the OPU, wherein a material roll with a higher roll width for longer objects are allowed to be conveyed in the first package material roll line, wherein a material roll with a smaller roll width for other objects are diverted by a diverter on a cross feed conveyor, wherein the one or more objects is autonomously actuated by the diverter based on associated length.

11. The processor implemented method of claim 9, wherein the first actuator corresponds to an object pusher vertical unit (OPVU), and the second actuator corresponds to an object pusher horizontal unit (OPHU) respectively, wherein the first actuator is in an upward position which is a default configuration allowing the one or more objects to pass through to the infeeder, wherein, the first actuator is moved vertically down until the level of the infeeder and the one or more objects are pushed by the second actuator based on a measured dimension associated with the one or more objects scanned through the object scanning unit, and wherein a stroke length upward and downward is always fixed for the first actuator.

12. The processor implemented method of claim 9, wherein top and bottom forming rods split into two parts to move vertically based on height of the one or more objects and then moved horizontally based on width of the one or more objects, wherein the one or more forming rods are withdrawn and move back to a default position, once the center sealing is performed, and wherein the default position corresponds to front end of the out feeder.

13. The processor implemented method of claim 9, wherein the top and bottom sealers move towards each other during sealing by an equidistant for sealing and move back to a default location after sealing.

14. The processor implemented method of claim 9, further comprising, positioning, by a bill printer, associated printed bill over each object, and wherein the bill printer is located below the mandrel on the machine structure frame.

15. The processor implemented method of claim 9, further comprising, sticking, by a label printer, an associated printed label over each package, wherein the label printer is located behind the web guide unit, wherein the associated printed label corresponds to an identifier associated with each package, and wherein quality of the associated printed label is validated.

16. The processor implemented method of claim 15, further comprising, allowing, by a package quality control unit, one or more qualified packages to pass through the exit conveyor.

17. One or more non-transitory machine-readable information storage mediums comprising one or more instructions which when executed by one or more hardware processors cause:

adjusting a pack forming unit based on measured a height and a width of one or more objects, wherein the infeeder is relocated to a default position, wherein the pack forming unit comprises of set of actuators and one or more forming rods, and wherein the one or more forming rods together with one or more hot sealing jaws with one or more fluted jaws create a hollow brick type cavity for a package;

moving a web guide roller in a pre-defined arc carrying a tail of a package material roll to align between the web guide roller and a nip roller, wherein the nip roller provides an additional friction for a material to be packaged, and wherein a web guide unit guides the aligned tail of the package material roll in a slot for the package material without wrinkles, wherein a mandrel is pneumatically expandable to hold a core of the packaging material, and wherein the mandrel can be rotated in a clockwise (CW) direction, or a counter-clockwise (CCW) direction respectively;

gripping by the package material gripping unit, the tensioned package material, wherein the package material gripping unit comprises of one or more vacuum grippers to firmly grip the material against a movement of the one or more forming rods, and wherein enough vacuum for every gripping stroke is generated by a vacuum generator;

pressing by one or more hot sealing jaws with one or more fluted jaws, the package material to seal at center with the one or more objects placed inside, wherein the sealing depends on a temperature, a pressure applied by the two hot sealing jaws on the material, and a dwell time;

carrying, by an out feeder, the one or more center sealed packed objects from the infeeder to an exit conveyor, wherein the exit conveyor is a last conveyor which takes the one or more center sealed packed objects to center of one or more pair of side sealers mounted on corresponding frame to seal the one or more objects; and sealing by the one or more pair of side sealers, the one or more center sealed packed objects at each side, and pushed through the exit conveyor, wherein the one or more pair of side sealers comprises a set of four hot sealers for sealing on both side of a formed pack, and wherein each pair with top and bottom sealers are placed on edge of the formed pack in a fixed location.

18. The one or more non-transitory machine-readable information storage mediums of claim 17, wherein the one or more objects are scanned by an object scanning unit to determine the one or more parameters, wherein the one or more parameters corresponds to: (i) width, and (ii) height, and wherein the one or more parameters are required to calculate quantity of packaging material required for a pack, for actuation of the one or more forming rods, and actuation of OPU, wherein a material roll with a higher roll width for longer objects are allowed to be conveyed in the first package material roll line, wherein a material roll with a smaller roll width for other objects are diverted by a diverter on a cross feed conveyor, wherein the one or more objects is autonomously actuated by the diverter based on associated length.

19. The one or more non-transitory machine-readable information storage mediums of claim 17, wherein the first actuator corresponds to an object pusher vertical unit (OPVU), and the second actuator corresponds to an object pusher horizontal unit (OPHU) respectively, wherein the first actuator is in an upward position which is a default configuration allowing the one or more objects to pass through to the infeeder, wherein the first actuator is moved vertically down until the level of the infeeder and the one or more objects are pushed by the second actuator based on a measured dimension associated with the one or more objects scanned through the object scanning unit, and wherein a stroke length upward and downward is always fixed for the first actuator.

* * * * *